US010005115B2

(12) United States Patent
Badea et al.

(10) Patent No.: US 10,005,115 B2
(45) Date of Patent: Jun. 26, 2018

(54) METHOD AND PROCESS, SYSTEM, AND APPARATUS FOR STRAIGHTENING OF THIN TUBULAR SHAPES

(71) Applicant: NATIONAL OILWELL VARCO, L.P., Houston, TX (US)

(72) Inventors: Gabriel M. Badea, Tujunga, CA (US); Josiah Morgan, Owasso, OK (US); Gregory A. Hart, Hayward, CA (US)

(73) Assignee: National Oilwell Varco, L.P., Houston, TX (US)

( * ) Notice: Subject to any disclaimer, the term of this patent is extended or adjusted under 35 U.S.C. 154(b) by 779 days.

(21) Appl. No.: 14/598,130

(22) Filed: Jan. 15, 2015

(65) Prior Publication Data

US 2015/0196945 A1 Jul. 16, 2015

Related U.S. Application Data

(60) Provisional application No. 61/927,902, filed on Jan. 15, 2014.

(51) Int. Cl.

| | |
|---|---|
| ***B21D 3/16*** | (2006.01) |
| ***B21C 51/00*** | (2006.01) |
| ***B21D 3/10*** | (2006.01) |

(52) U.S. Cl.

CPC ..... *B21C 51/00* (2013.01); *B21D 3/10* (2013.01)

(58) Field of Classification Search

CPC ..... B21C 51/00; B21D 3/10; B25B 1/103; B25B 1/20; B25B 5/04; B25B 1/00

USPC ..... 72/17.3

See application file for complete search history.

(56) References Cited

U.S. PATENT DOCUMENTS

| | | | | |
|---|---|---|---|---|
| 4,144,730 | A | 3/1979 | Judge, Jr. | |
| 9,539,635 | B2 * | 1/2017 | Mitze | B21D 3/10 |
| 2013/0180307 | A1 | 7/2013 | Mitze | |

FOREIGN PATENT DOCUMENTS

| | | | |
|---|---|---|---|
| DE | 24 52 435 | A1 | 5/1976 |
| DE | 20 2006 008 001 | U1 | 9/2007 |
| DE | 20 2010 011 975 | U1 | 12/2011 |
| JP | S57 1520 | A | 1/1982 |

(Continued)

OTHER PUBLICATIONS

Invitation to Pay Additional Fees and, Where Applicable, Protest Fee from corresponding International Application No. PCT/US2015/011647, filed Jan. 15, 2015. Invitation to Pay Additional Fees and, Where Applicable, Protest Fee dated Mar. 24, 2015 (5 pgs.).

(Continued)

*Primary Examiner* — David B Jones

(74) *Attorney, Agent, or Firm* — Jonathan M. Pierce; Porter Hedges LLP

(57) ABSTRACT

A method, process, system, and apparatus for straightening of thin tubular shapes. A method of straightening of thin tubular shapes includes: supporting a tubular product between a plurality of first support members and a plurality of second support members of a bending apparatus; applying loads to the tubular product at respective locations along a length of the tubular product using a plurality of actuators of the bending apparatus; and using a recipe-based program to calculate the loads at the respective locations and control the plurality of actuators to apply the loads.

20 Claims, 7 Drawing Sheets

(56) References Cited

FOREIGN PATENT DOCUMENTS

| | | | |
|---|---|---|---|
| JP | H07 284853 | A | 10/1995 |
| SU | 848 119 | A1 | 7/1981 |

OTHER PUBLICATIONS

International Search Report from corresponding International Application No. PCT/US2015/011647, filed Jan. 15, 2015, International Search Report dated Jul. 8, 2015 and dated Jul. 21, 2015 (7 pgs.).

Written Opinion of the International Searching Authority from corresponding International Application No. PCT/US2015/011647, filed Jan. 15, 2015, International Search Report dated Jul. 21, 2015 (8 pgs.).

* cited by examiner

METHOD AND PROCESS, SYSTEM, AND APPARATUS FOR STRAIGHTENING OF THIN TUBULAR SHAPES

CROSS-REFERENCE TO RELATED APPLICATION

This application claims the benefit of U.S. Provisional Patent Application Ser. No. 61/927,902, filed on Jan. 15, 2014, the entire content of which is hereby incorporated by reference.

FIELD

Embodiments of the present invention relate to a method and process for straightening of thin tubular shapes, a system for straightening of thin tubular shapes, and an apparatus for straightening of thin tubular shapes.

BACKGROUND

One common method used in the industry to produce tubular shapes is the longitudinally welded U-ing/O-ing process. It is a common occurrence that at the end of this process, due to the thermal stresses induced by the welding and cooling rate of the weld, the resulting tubular product is bowed, which is also commonly referred to in the industry as "banana shaped."

Therefore, an additional operation is necessary to straighten the product within industry accepted tolerances. This process, as known from the state of the art, has numerous deficiencies.

A common practice in tube straightening is to first measure, which is often done manually, the bow of the tubular product, generally at multiple locations. Then, a straightening apparatus is set with physical stops, or hard stops, at the same locations where the measurements were taken, and on the opposite side of the bow.

The rule of thumb is that the hard stops are set to allow a deflection approximately two times the value of the measured bow. The tube is then bent until it touches the physical stops, and then relaxed, and the bow is measured again. If the result is not satisfactory by given acceptance criteria, the hard stops are adjusted to allow for more bending.

When a second bending is required, one problem with the above-described process is that the adjustment of the hard stops is entirely experience-based, and, therefore, there is an increased risk of denting the tube, which results in an unacceptable product. One other problem of the above-described process is that, the longer the tube, the more measurements need to be taken, and more hard stops have to be set.

The above-described conventional process is slow, labor intensive, requires highly skilled operators, and is subject to error. Further, the process is highly dependent on a ratio of the diameter to the wall thickness of the tube, i.e. (D/t). While this ratio is a constant value for straight tubes, in the case of taper tubes, this ratio varies along the length of the tube. No method is available, other than operator experience, to take this ratio into account, let alone to deal with a variable ratio.

Even more, the physical properties of the tube material are very important, and there is no way to take them into account with the described state of the art.

SUMMARY

According to an aspect of embodiments of the present invention, a novel method and process for straightening of thin tubular shapes can account for physical and geometric properties of the product and eliminates the need for hard stops, and the subsequent additional setup time required. According to another aspect of embodiments of the present invention, a system for straightening of thin tubular shapes is provided. According to another aspect of embodiments of the present invention, an apparatus for straightening of thin tubular shapes is provided.

According to an aspect of embodiments of the present invention, a novel method and process for straightening tubular products is based on relevant engineering calculations, also described in principle herein, which calculations are implemented in a machine control program, and which program integrated with the appropriate mechanical hardware results in an automated straightening process of hollow tubular products.

According to another aspect of embodiments of the present invention, a large amount of custom tooling required by the conventional process when a large variety of tube diameters is produced is reduced or minimized, which may be especially significant for taper tubes. Provided is a novel, intelligent, and reliable straightening method and process which can be implemented in a highly automated machine.

According to another aspect of embodiments of the present invention, an "air-bending" process and system eliminates the need for the hard stops of the conventional process, and uses multiple actuators (e.g., hydraulic cylinders) for application of the bending load.

According to an embodiment of the present invention, a method of straightening of thin tubular shapes includes: supporting a tubular product between a plurality of first support members and a plurality of second support members of a bending apparatus; applying loads to the tubular product at respective locations along a length of the tubular product using a plurality of actuators of the bending apparatus; and using a recipe-based program to calculate the loads at the respective locations and control the plurality of actuators to apply the loads.

The method may further include: measuring forces and displacements at the respective locations using at least one measuring device; calculating a spring back ratio of the tubular product based on the measured forces and displacements; and again applying loads to the tubular product at the respective locations based on the calculated spring back ratio.

The method may further include determining a safe moment at each of the respective locations and calculating the loads at the respective locations based on a recipe of the recipe-based program.

The method may further include inputting measurement information into a recipe of the recipe-based program to self-teach the recipe-based program. The measurement information may include position and force measurements, and the method may further include monitoring a relationship between the position and force measurements to detect a yield of the tubular product. The method may further include dynamically adjusting the loads applied to the actuators when the yield of the tubular product is detected.

The tubular product may be a taper tube having a cross-sectional area that decreases along a length of the tubular product.

According to another embodiment of the present invention, a system for straightening of thin tubular shapes includes: a bending machine including a plurality of first support members configured to support a tubular product at a first side, a plurality of second support members configured to support the tubular product at a second side opposite the first side, and a plurality of actuators, each configured to apply a respective load to a respective first support member of the plurality of first support members; and a computing system provided with a recipe-based program to control forces applied by the plurality of actuators at respective locations of the tubular product along a lengthwise direction to straighten the tubular product.

The system may further include at least one measuring device configured to send measurement information to the computing system.

The recipe-based program may be self-teaching based on the measurement information received by the computing system from the at least one measuring device.

The at least one measuring device may include at least one laser distance measurement sensor configured to measure a straightness of the tubular product. In one embodiment, the at least one measuring device includes a plurality of laser distance measurement sensors configured to measure the straightness of the tubular product.

The at least one measuring device may include a plurality of position measuring devices associated with respective actuators of the plurality of actuators, and a plurality of force measuring devices associated with the respective actuators.

The system may further include an unloading sub-system configured to unload the tubular product after straightening from the bending machine.

According to another embodiment of the present invention, an apparatus for straightening of thin tubular shapes includes: a plurality of first support members configured to support a tubular product at a first side; a plurality of second support members configured to support the tubular product at a second side opposite the first side; and a plurality of actuators, each configured to apply a respective load to a respective first support member of the plurality of first support members, and at least one support member from among at least one of the plurality of first support members or the plurality of second support members is movable along a lengthwise direction of the apparatus.

In one embodiment, locations of the first support members may be fixed along the lengthwise direction of the apparatus. In another embodiment, the first support members are movable along the lengthwise direction of the apparatus.

The second support members may be movable along the lengthwise direction of the apparatus.

The apparatus may further include at least one laser distance measurement sensor configured to measure a straightness of the tubular product. In one embodiment, the apparatus includes a plurality of laser distance measurement sensors configured to measure the straightness of the tubular product.

Other features and advantages of embodiments of the present invention will become apparent from the following detailed description, taken in conjunction with the accompanying drawings which illustrate, by way of example, features and aspects of the present invention.

BRIEF DESCRIPTION OF THE DRAWINGS

The above and other features, aspects, and advantages of the present invention will become better understood with regard to the following description, appended claims, and accompanying drawings where:

DETAILED DESCRIPTION

In the following detailed description, certain exemplary embodiments of the present invention are shown and described, by way of illustration. As those skilled in the art would recognize, the described exemplary embodiments may be modified in various ways without departing from the spirit and scope of the present invention. Accordingly, the drawings and description are to be regarded as illustrative in nature, rather than restrictive.

Figure 1:
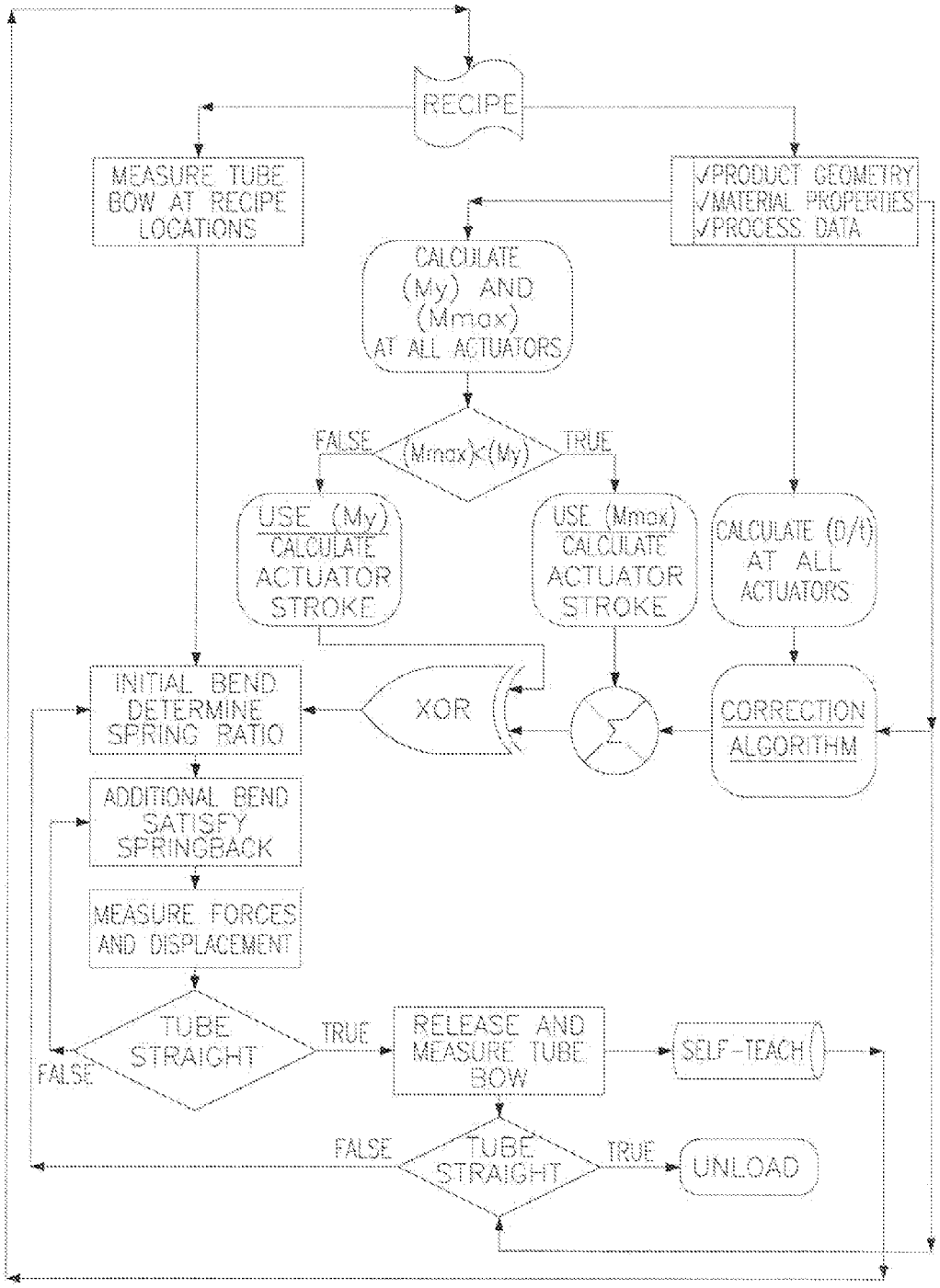
FIG. 1 is a logic diagram of a method for straightening of thin tubular shapes, according to an embodiment of the present invention.

FIG. 1 is a logic diagram of a method for straightening of thin tubular shapes, according to an embodiment of the present invention.

With reference to FIG. 1, the method for straightening of thin tubular shapes or products is based on a recipe-type control, a database in nature, which is tightly integrated with a master program that controls the equipment in the production line. According to embodiments of the present invention, the master program monitors information received from the recipe and transducers, and sends instructions to actuators in the production line to perform the bending. The recipe, in one embodiment, includes geometry and material properties of the tubular product, process and test data, and an acceptable bow amount of the tubular product. In one embodiment, measurement information, such as position and force measurements associated with actuators applying loads to the tubular product, and distance measurements associated with straightness of the tubular product, are sent from the transducers to the master program and stored in the recipe, such that the master program is self-teaching.

Figure 2:
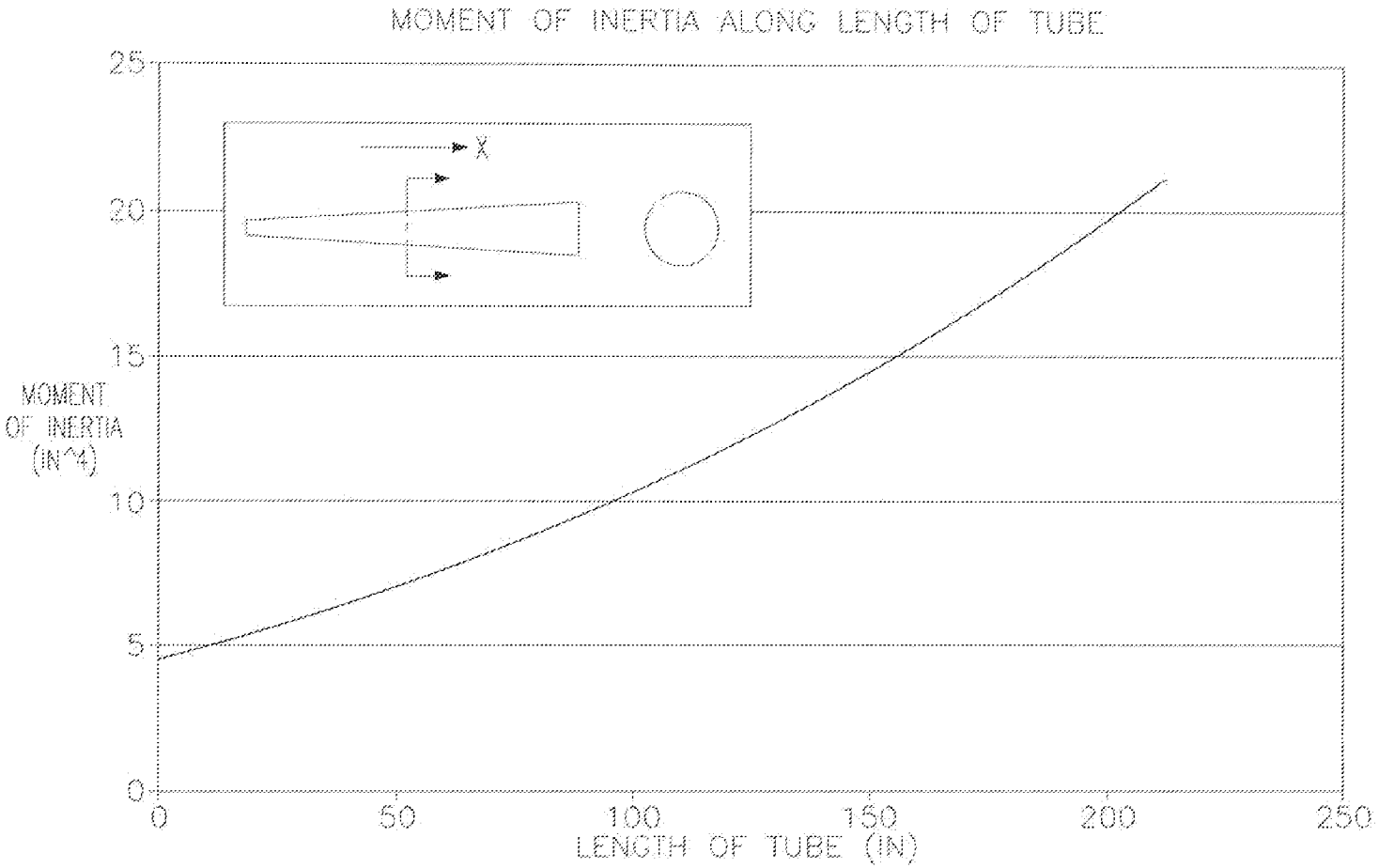
FIG. 2 is a graph of a cross-sectional moment of inertia along a length of an example taper tube.
Figure 3:
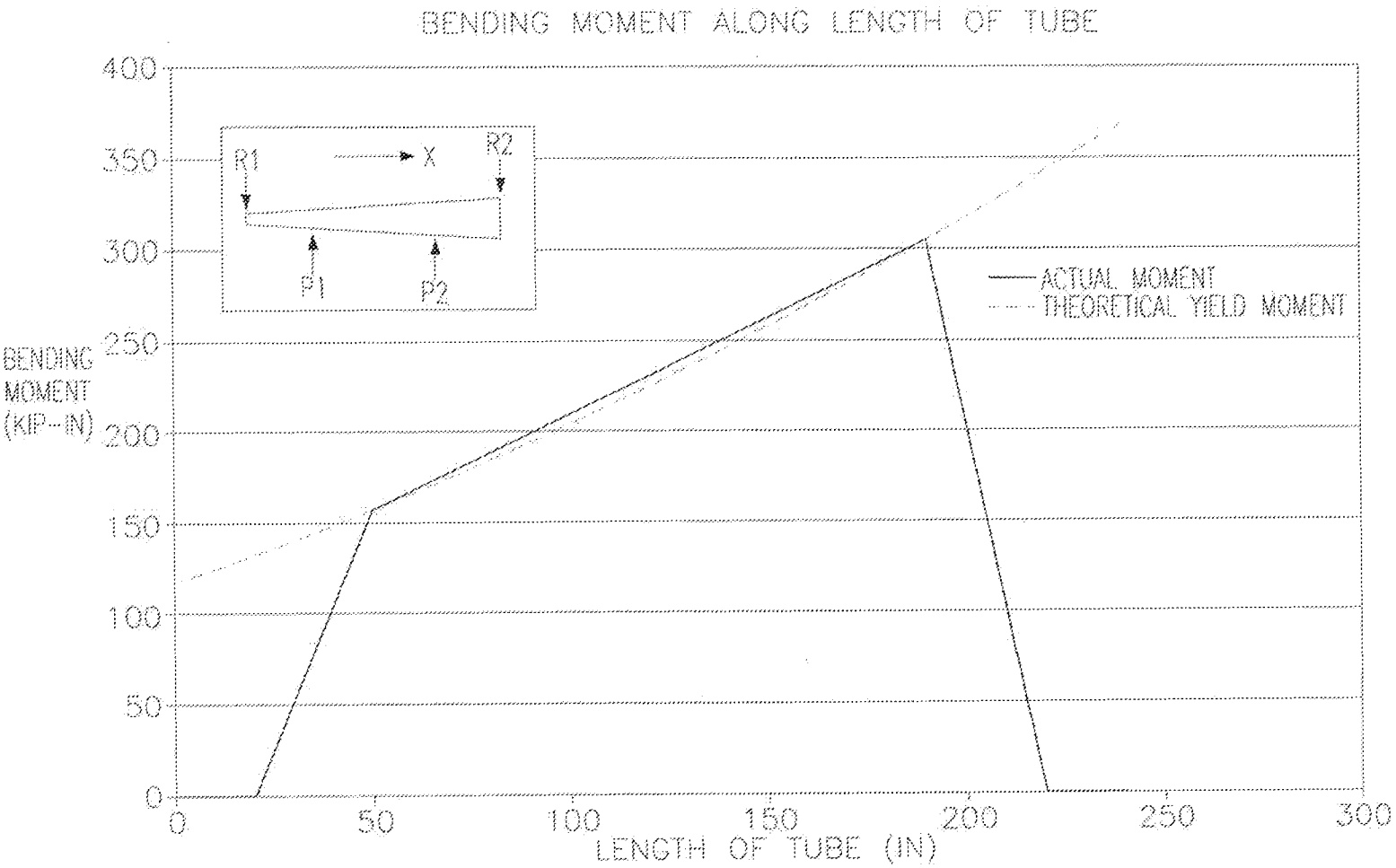
FIG. 3 is a graph of a bending moment along a length of an example taper tube to uniformly yield the taper tube, and also showing an actual bending moment along the length of the example taper tube resulting from a load from two actuators.

It is important in straightening a tube to achieve a constant or approximately constant stress along the length of the tube so that the whole tube may bend and spring back uniformly. As shown in FIG. 2, tapered tubes do not have a constant cross-sectional moment of inertia along the length of the tube. For this reason, according to an embodiment of the present invention, the amount of bending moment applied to the tube is varied along the length of the tube, as shown in FIG. 3. That is, in FIG. 3, the dashed line indicates a bending moment along a length of an example taper tube to uniformly yield the taper tube, and the solid line illustrates an actual bending moment along the length of the example taper tube resulting from a load from two actuators (i.e., loads P1 and P2).

Before the tube is bent, based on information from the recipe, and taking into account the principles presented below, the program first determines the preferred actuator locations to be used in the process. Then, the program calculates the forces needed to reach an arbitrary stress load throughout the length of the tubular product.

According to embodiments of the present invention, the actuators receive stroke distance instructions, and the program calculates what displacements would be expected to result from the resulting forces being applied to the product. The results of this calculation give the program a theoretical ratio for the actuators to stroke in order for the tube to relax to a straightened position when the actuators are unloaded.

After making these determinations, the program then instructs the actuators to stroke to a location maintaining this ratio (below the minimum yield of the material). When the actuators reach the assigned location, the program then reads the forces applied to the transducers as well as the maximum deflection of the tube. The program then instructs the actuators to stroke to a second location maintaining the same stroke ratio between the actuators, also below the minimum yield of the material. The minimum yield of the material may not be a known value due to work hardening.

The program then reads the forces and displacements and compares the forces and displacements between the two previous steps. Based on this information, the program is able to determine the spring back ratio for the tube.

In the final step, the program begins an iterative loop of instructing the actuators to stroke further, using the same ratio as before, while checking the force and displacement. Once the program determines that the force and displacement values generated by the transducers would result in a straight tube using the calculated spring back ratio, the program then instructs the actuators to relax and the bending process is complete.

The method and process, as described so far, is also provided with the capability to actively gather process data, and then a self-teaching algorithm can be used for more accurate determination of such (D/t) ratios related to correction factors as described below.

Furthermore, based on said self-teaching mode, a separate algorithm determines whether the limiting moment is large enough to straighten the tube and/or additional actuators need to be programmed to distribute the load.

Figure 4:
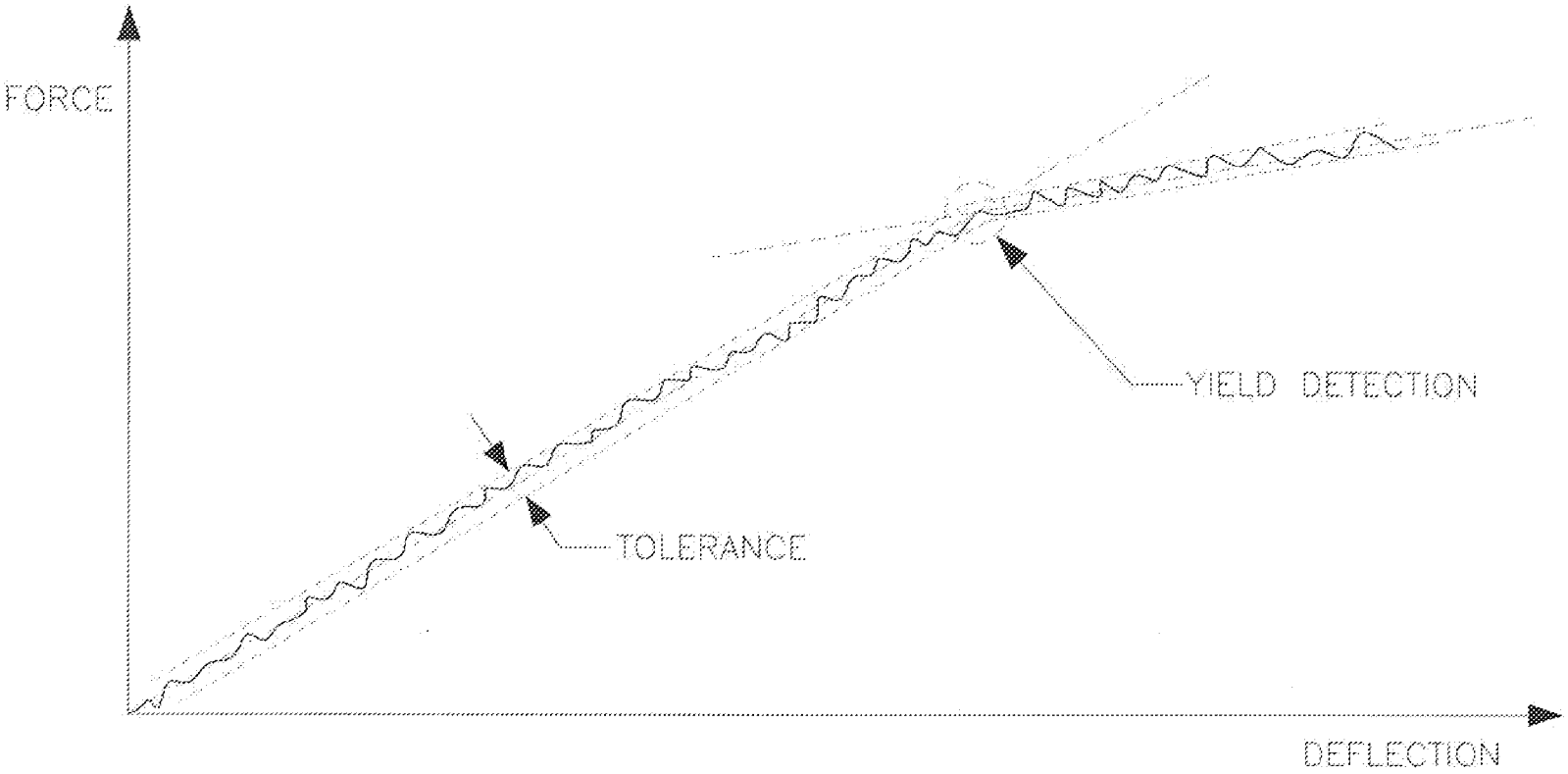
FIG. 4 is a graph showing a relation between force and displacement during a process of straightening a thin tubular shape, according to an embodiment of the present invention.

As discussed above, the minimum yield of the material may not be known due to work hardening, or strain hardening, and in one embodiment as described above, the preferred actuator locations and theoretical ratio for the actuators to stroke may be determined from the recipe and an estimated minimum yield. In another embodiment, the yield may be determined during the process of straightening. According to embodiments of the present invention, the system has a multitude of position and force measurement capabilities, and, therefore, the relation between force and displacement can be monitored and plotted during the "air bending" process, as shown in FIG. 4. The wiggled line represents actual force versus displacement measurements. The measurements vary within a certain tolerance range as shown in FIG. 4. The dashed lines represent an average slope of the measured force versus displacement measurements at respective sides of a yield of the hollow section material. When yield of the hollow section material is reached, there is a notable change in the slope of the measurement as shown in FIG. 4. This allows for a method to straighten the hollow section even if the physical properties of the material, i.e. yield strength, are not known from the recipe-based system. The average tolerance can be measured and projected in the early stages of the bending process. This, combined with the self-teaching concept, allows for a high accuracy in the determination of the yield point of the material. In the "air bending" process, the scope is to maintain uniform stress in the section, which means that yield should be attained at all actuating locations at the same time. By monitoring and plotting the measurements at all actuation locations, as shown in FIG. 4, a method to verify the theoretically determined stroke ratio, as described above, is provided, as well as to dynamically correct it during the straightening process. This further enhances the self-teaching capabilities of the system.

After preliminary tests, it was determined that a method was needed in order to determine the maximum force that can be applied to the tube. This is described further below.

In one preliminary development, a calculation and straightening method was created which is based on what is known to those skilled in the art as the elastic theory principle applied with a calculation method derived from the conjugate beam theory. This preliminary method starts from known yield strength of the material, and a strategic application of the "air bending" loads, and it determines the bending moment and the deflection at any given position along the tube. In other words, the yield moment ($M_y$) at any given position along the tube is calculated, and it assumes that a straight tube can be obtained once a certain, relatively uniform stress is reached along most of the length of the subject tube.

This elastic method does account for the variable (D/t) ratio as well as the variable moment of inertia, as is the case with taper tubes. However, it was found that it cannot account for the effects of the changing (D/t) ratio and cannot eliminate the danger of over-bending the tube, ovalizing the tube, or, worse yet, denting the tube.

The effect of the (D/t) ratio, and hence the undesired effects like ovalization, denting, or collapse, is related to reaching a moment ($M_{max}$), which, depending on the (D/t) ratio, may be larger or smaller than the yield moment ($M_y$). Theoretically, in certain cases ($M_{max}$) may even be larger than the plastic moment ($M_p$).

Comparable to other accepted engineering criteria, a general classification of tubes is defined herein, with ($M_{max}$) as the most important parameter as follows: (1) compact (D/t<30), where (Mmax)>(Mp); (2) non-compact (30<D/t<70), where (My)<(Mmax)<(Mp); and (3) slender (D/t>70), where (Mmax)<(1).

The process represented in FIG. 1 calculates all the relevant parameters, and based on a decision system solves the issues described above to achieve a consistent and reliable straightening process.

In analyzing the bending process of a hollow tube, generally, the complete collapse mechanism of tubes subject to bending can be divided into the three phases of elastic behavior, ovalization, and structural collapse. Elastic behavior is highly dependent on the (D/t) ratio and subject to the compact, non-compact, and, respectively, slender characterization of the specific tube/beam to be analyzed. Ovalization is permanent deformation, which may or may not be acceptable. Ovalization precedes structural collapse, and the boundary between the two is very narrow. In structural collapse, the tube collapses, either in a localized fashion at or close to the load application position, which is called a dent, or in a more catastrophic manner, which exhibits buckling propagating over a significant length of the tube.

All of the forms of structural collapse need to be safely avoided. Further, only small amounts of permanent ovalization are acceptable in the industry.

The elastic analysis is established and verified, as explained. Based on the theory described above, a calculation for ($M_{max}$) is performed, and then the relation between this moment and ($M_y$) and ($M_p$) is evaluated. The straightening process is conducted according to this evaluation.

There are a number of theories available to calculate elastic/plastic tube ovalization. Most of them are some form of modern variations of the theory developed by Brazier in 1927. However, it can be proven that none of these can be used for a reliable process. For example purposes, only two examples of equations to be used in the method and process are described below, though other forms may be used.

Experimental research has determined that permanent onset of ovalization, occurs when the cross-section of the tube is deformed to an ellipse with the major axis of (1.10 D) and the minor axis (0.90 D), where (D) is the outside diameter of the tube. This is a first example using the "simplified ovalization" equation:

$$M_{max} = \frac{4}{3} \cdot (R_v^2 \cdot R_h - R_{vi}^2 R_{hi}) \cdot \sigma_y$$

($\sigma_y$) is the yield strength of the material;

where: $R_v = \frac{D_v}{2} = 0.45 \cdot D$ $R_h = \frac{D_h}{2} = 0.55 \cdot D$ $R_{vi} = R_v - t$ ($t$) is the wall thickness of the tube $R_{hi} = R_h - t.$ A second example of such an equation is a moment stress integration equation and has the form:

$$M_{max} = 3.066 \cdot t \cdot \left(\frac{D}{2}\right)^2 \cdot \sigma_y$$

($\sigma_y$) is the yield strength of the material.

For all intents and purposes, the straightening process is limited to a rigid-elastic process that yields the tube material just enough to achieve the desired results and to avoid secondary effects such as ovalizing or denting. Therefore, the goal is to determine the safe moment ($M_{max}$) required to straighten the tube within the acceptable tolerance. The program then straightens the tube using the smaller value of (Mmax)<(My). Also, depending on experimental data results, a safety factor may be used, as described further below, in order to obtain the safe moment.

Some examples of test results which prove the validity of the overall approach are described below.

According to one example, a 30-foot long taper tube with a 3.875-inch small diameter and a 8.000-inch large diameter was produced. The tube material was low-carbon steel having approximately 60 ksi average yield strength and a 0.1196-inch wall thickness. The bow of the produced tube was measured to be approximately 2 inches at 5 feet from the small end, and 1.375 inches at 25 feet from the small end.

In bending the above-described example taper tube by applying the conventional method, hard stops were set at 4 inches and 2.75 inches, respectively, loads were applied at the same locations, and the tube was bent against the hard stops. After releasing the load, the tube had a bow of approximately 0.4375 inches, which is not within acceptable limits. A second bend was required.

However, according to an embodiment of the present invention, using the simple elastic analysis method, an identical tube was bent to 7 inches and 6 inches, respectively, at the same locations as above, and the tube was straight within 0.200 inches. This is considered to be a good result.

Yet another experiment was done, identical to the two above, except that the displacements at 5 feet and 25 feet from the small end were increased 7.25-inch and 6.25-inch, respectively. Although only a small increase, the tube was over-bent, i.e. bowed in an opposite direction from before at approximately 0.375 inches. This is borderline within the desired limits.

Finally, the simple elastic analysis method was used again to determine required displacement at 2.5 feet (instead of 5 feet) and 25 feet from the small end. According to the calculation, the displacements were set to approximately 3.875-inch and 5.625-inch, respectively. This resulted in a straight tube, except that denting occurred at the 25-foot load application point, which is not acceptable.

However, some experimental investigations are available in the industry, which have determined that the first of the two example equations described above, in most cases, overestimates ($M_{max}$). It is expected that this overestimation is quite significant at very high (D/t) ratios (i.e. slender sections), but only the following test data has been obtained thus far.

| D/t | 21.16 | 25.65 | 26.03 | 32.97 | 36.59 | 42.57 |
|---|---|---|---|---|---|---|
| Experimental Moment (kNm) | 3.20 | 1.85 | 1.12 | 1.76 | 1.09 | 2.38 |
| Calculated Moment (kNm) | 3.02 | 2.12 | 1.18 | 2.09 | 1.13 | 2.76 |
| Error, Calculated/ Experimental | 0.94 | 1.15 | 1.05 | 1.19 | 1.04 | 1.16 |

Returning to the 30-foot tube in the test result examples described above, the calculation results for the 25-foot bending load position are as follows:

$M_y$=23000 ft-lbf $M_{max}$=27646 ft-lbf as calculated, $M_{max}$=23832 ft-lbf and adjusted for an assumed 16% over estimation (see table of test data above).

The above moments are quite comparable, which indicates the danger of denting the tube. Also, the (D/t) ratio in this example is 61, which is significantly greater than the available data from experiments. Therefore, a correction factor greater than the assumed 16% correction factor may be required.

In another example, a taper tube had a length of 45 feet, a same material as the previously described example, a 3.875-inch small end, and a 10.0625-inch large end. This example tube was straightened by applying the bending loads at 2.50 feet and 40 feet, respectively, from the small end. The calculation results at the 40-foot bending load location were:

$M_y$=44493 ft-lbf $M_{max}$=48455 ft-lbf as calculated, $M_{max}$=41771 ft-lbf and adjusted for an assumed 16% over estimation.

This indicates that, in this case, ($M_{max}$) was the limiting bending moment for the process. Furthermore, calculating the moments at the 2.50-foot bending load location:

$M_y$=8596 ft-lbf $M_{max}$=7629 ft-lbf as calculated, and $M_{max}$=7335 ft-lbf adjusted for an assumed only 4% over estimation.

This value was chosen conservatively because the tube at this location has a (D/t) ratio of 35.27, which is close enough to the 36.59 value in the above table of test data.

From these calculations, it can be concluded that, in this example, ($M_{max}$) was the limiting moment at both locations of the applied bending load.

Using the second equation introduced above, the results are:

$M_{max}$=4101.4 ft-lbf as calculated, at the 40-foot bending load location $M_{max}$=6673 ft-lbf as calculated, at the 2.50-foot bending load location.

The above-described theoretical developments are implemented in the master program used in the method of straightening of thin tubular shapes according to embodiments of the present invention, as described above.

Figure 5:
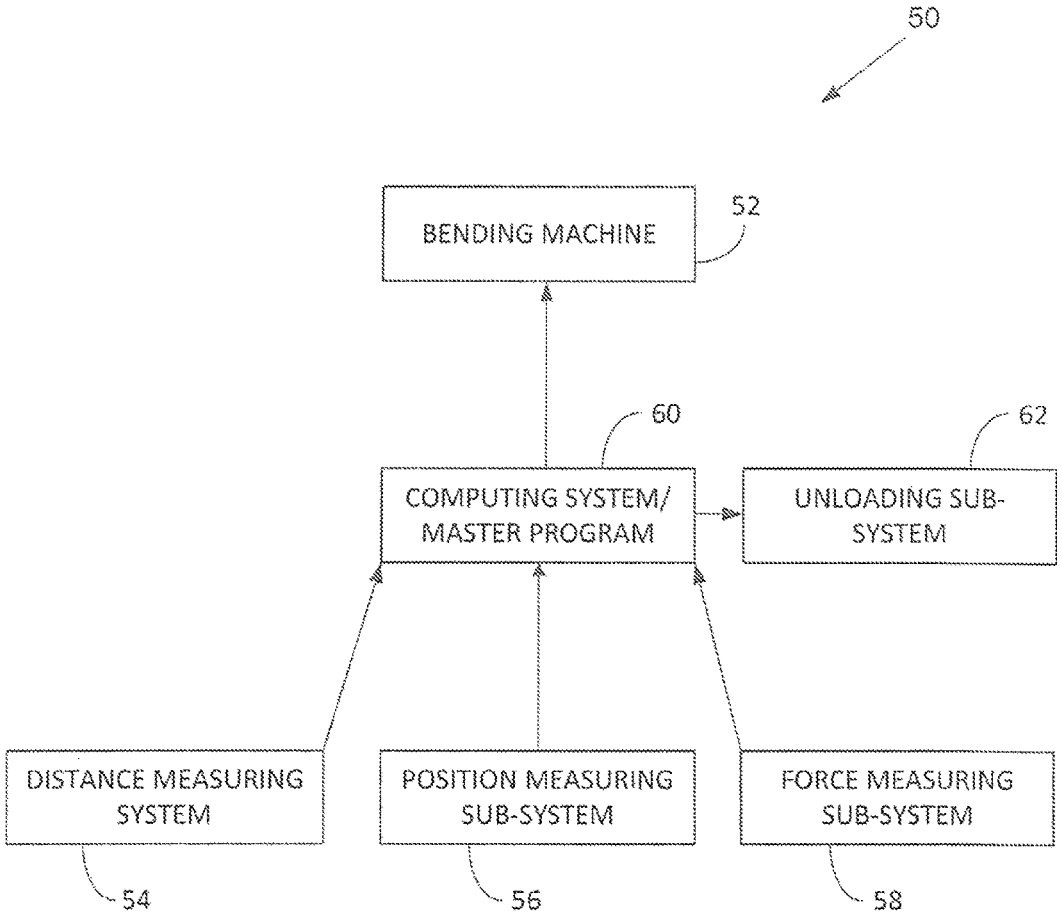
FIG. 5 is a block diagram of a system for straightening of thin tubular shapes, according to an embodiment of the present invention.

FIG. 5 is a block diagram of a system for straightening of thin tubular shapes, according to an embodiment of the present invention.

With reference to FIG. 5, according to an embodiment of the present invention, a system 50 for straightening of thin tubular shapes includes a bending machine 52, i.e. an "air-bending" machine, a distance measurement system 54, a position measuring sub-system 56 as part of a position control system, a force measuring sub-system 58 as part of a force control system, and a computing system 60 for running the master program. The system 50, for example, may be used in the method for straightening of thin tubular shapes described above with respect to FIG. 1.

The bending machine 52, which eliminates the need for hard stops, includes a plurality of actuators (e.g., hydraulic cylinders) for the application of the bending load. The bending machine 52, in one embodiment of the present invention, may be embodied as the bending apparatus described later herein and shown in FIGS. 6 and 7.

The distance measurement system 54, in one embodiment, includes laser distance measurement sensors for measuring the bow or straightness of the tube, before and after straightening, as a component of the self-teaching mode of the system 50. In one embodiment, for example, the distance measurement system 54 includes DT50 series laser distance measurement sensors manufactured by SICK® AG. However, in other embodiments, any other suitable distance measuring sensor may be used. Further, the distance measurement system 54 may include any suitable number of the laser distance measurement sensors, and, in one embodiment, for example, includes twelve laser distance measurement sensors.

The position control system is associated with the actuators of the bending machine 52 to accurately control and feedback the deflection of the tubular product at the locations of the calculated bending loads. The position control system includes the position measuring sub-system 56 to measure the deflection of the tube from the applied straightening loads. In one embodiment, the position measuring sub-system 56 may include linear transducers, such as MTS Temposonics® sensors based on magnetostrictive sensing technology, which may be installed in the actuators (e.g., hydraulic cylinders) of the bending machine 52. In another embodiment, any of various other suitable types of position encoders may be used, such as a position measuring device to suitably operate with a screw jack actuator of the bending machine 52.

The force control system is associated with the actuators of the bending machine 52 to accurately control and feedback the bending moment at the preferred locations along the tubular product. The force control system includes the force measuring sub-system 58 to monitor the applied straightening loads. In one embodiment, the force measuring sub-system 58 may be implemented using pressure traducers in a hydraulic design to be used with the actuators (e.g., hydraulic cylinders) of the bending machine 52. In another embodiment, a torque measurement system may be used in combination with the actuators (e.g., screw jacks) of the bending machine 52.

The computing system 60 running the master program implements the algorithm developed from the analysis method, and is used to control, integrate, and receive information from the above-described components of the system 50.

In one embodiment, the system 50 for straightening of thin tubular shapes may further include an unloading sub-system 62. The unloading sub-system 62 may be a pick-and-place sub-system used to unload the straightened tubes from the bending machine 52 and position the straightened tubes in designated (e.g., temporary) storage areas or movable carts to transport said tubes to other processing stations. The unloading sub-system 62, in one embodiment, is also controlled by the computing system 60, and operationally integrated with the bending machine 52. Although not shown, in one embodiment, the system 50 for straightening of thin tubular shapes may further include a loading sub-system, such as a pick-and place sub-system, used to load the tubular products into the bending machine 52.

In one embodiment, some of the sub-systems of the system 50 for straightening of thin tubular shapes may be integrated with the bending machine 52. For example, the position measuring sub-system 56 may be integrated with the bending machine 52, as shown in the embodiment illustrated in FIGS. 6 and 7, for example. Similarly, the force measuring sub-system 58 may be integrated with the bending machine 52, as shown in the embodiment illustrated in FIGS. 6 and 7, for example. Also, for example, the laser distance measurement sensors of the distance measurement system 54 may be integrated with the bending machine 52, as shown in the embodiment illustrated in FIGS. 6 and 7, for example.

Figure 6:
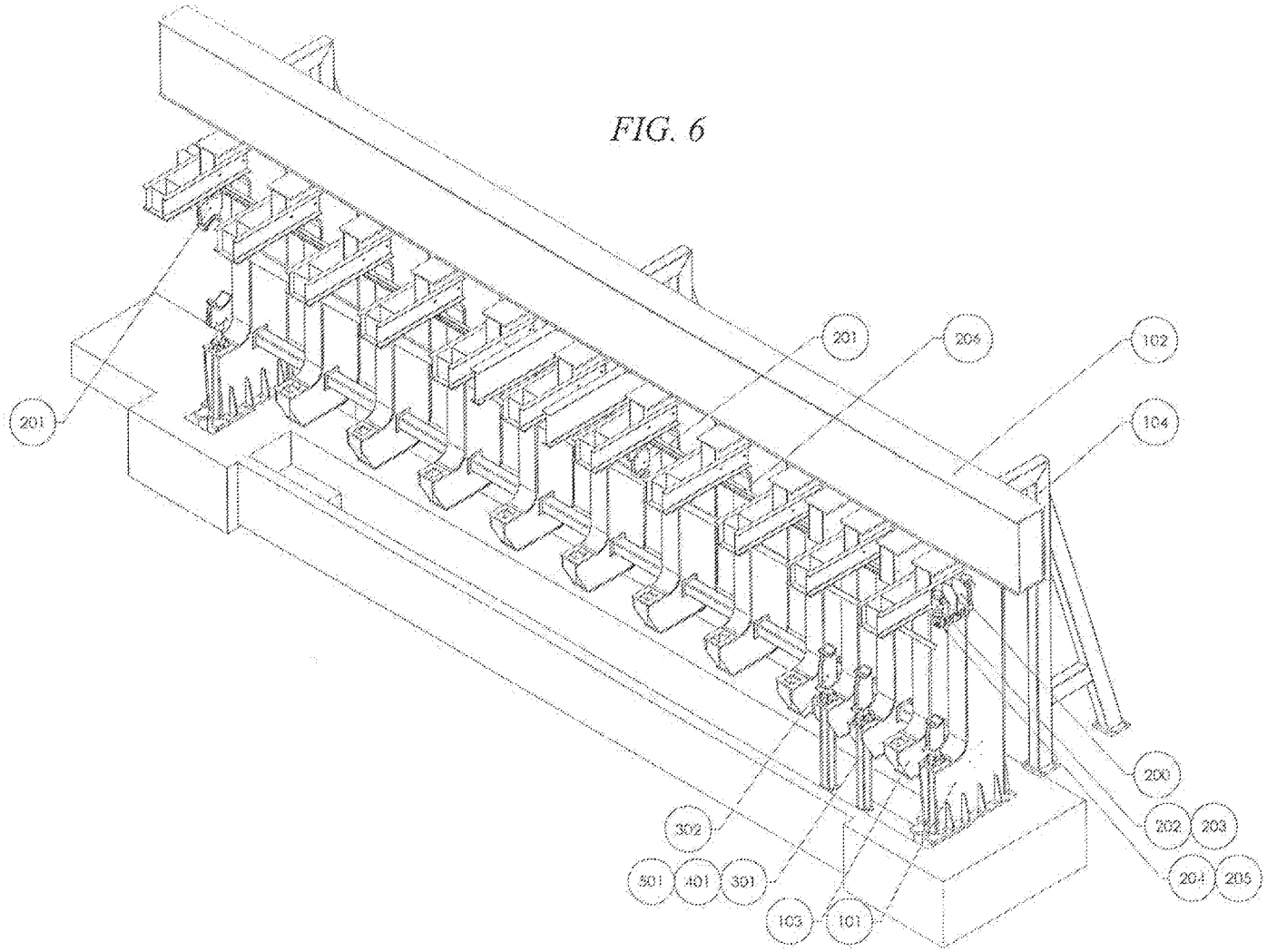
FIG. 6 is a perspective view of an apparatus for straightening of thin tubular shapes, according to an embodiment of the present invention.
Figure 7:
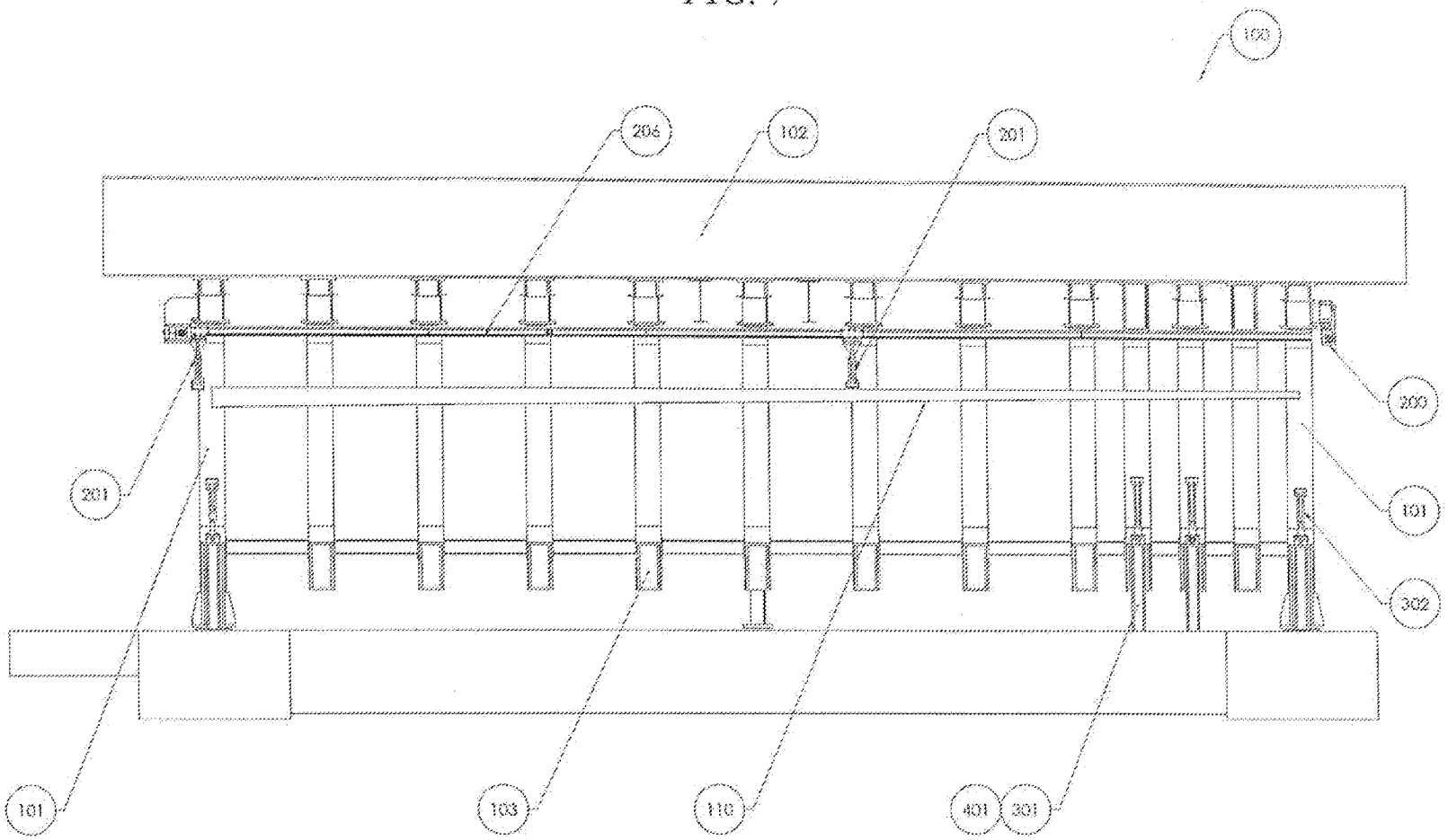
FIG. 7 is a front view of the apparatus for straightening of thin tubular shapes of FIG. 6.

With reference to FIGS. 6 and 7, an apparatus 100 for straightening of thin tubular shapes according to an embodiment of the present invention includes a plurality of actuators 301 to apply loads at locations along a length of a tubular product 110. The apparatus 100, for example, may be implemented in the system 50 for straightening of thin tubular shapes described above as the bending machine 52, and may be used in the method for straightening of thin tubular shapes described above with respect to FIG. 1. The tubular product 110, in one embodiment, is a taper tube having a cross-sectional area that decreases along a length of the tubular product 110. However, in other embodiments, the tubular product 110 may be round, having a constant cross-section, or profiled.

The apparatus 100 for straightening of thin tubular shapes is designed and configured to withstand the large loads applied in the straightening process. According to one embodiment, the apparatus 100 includes two end pedestals 101 which support an upper substantial box beam 102. In one embodiment, a plurality of C-frames 103 for mounting the actuators 301 described below hang from the box beam 102. The number of C-frames 103, in one embodiment, may be eleven; however, embodiments of the present invention are not limited thereto. An additional support structure 104 may be provided as required by sound engineering practice. In another embodiment, the C-frames 103 may be floor mounted, either fixed or movable, to accommodate the chosen linear actuator system, as described below. In one embodiment, the apparatus 100 is capable of straightening tubes up to 50 feet long, 30-inches in diameter, and having a 0.50-inch wall thickness. However, embodiments of the present invention are not limited thereto.

In one embodiment, the apparatus 100 includes an upper drive mechanism 200 to independently position a plurality of support members, such as upper support saddles 201, at desired locations with respect to a centerline of the apparatus 100. In one embodiment, the upper drive mechanism 200 includes one or more electrical motors 202 provided with position encoders 203 and a mechanical system comprising a gear box 204, belt drive 205, and a linear rail 200 to convert the rotation to linear motion.

The apparatus 100 further includes the plurality of actuators 301, such as along the centerline of the machine, each provided at the top with a corresponding one of a plurality of support members, such as a shaped saddle 302, or other suitable tooling, and which apply the desired load to straighten the tube, as described above with respect to the method. In one embodiment, the actuators 301 may be at fixed locations in a lengthwise direction of the apparatus 100, and, in one embodiment may include thirteen or approximately thirteen of the actuators 301. In another embodiment, however, the actuators 301 may be provided on a linear motion device to allow independent positioning at locations along the lengthwise direction of the apparatus 100, and the positions may be determined as described above with respect to the straightening method. According to the embodiment in which the actuators 301 are movable along the lengthwise direction of the apparatus 100, the number of actuators 301 may be reduced, such as to six or fewer. In one embodiment, the actuators 301 are hydraulic cylinders, such as Parker® hydraulic cylinders. However, the present invention is not limited thereto, and in another embodiment, the actuators 301 may be any other suitable linear actuators (e.g., screw jacks).

In one embodiment, the apparatus 100 may further include linear transducers 401 associated with the actuators 301 for measuring a deflection of the tubular product 110 from the load applied by a respective one of the actuators 301. Similarly, the apparatus 100 may further include pressure transducers (not shown) associated with the actuators 301 for measuring the load applied by a respective one of the actuators 301. In one embodiment, the apparatus 100 may further include laser distance measurement sensors 501 for measuring the bow or straightness of the tubular product 110. The apparatus 100 may include any suitable number of the laser distance measurement sensors 501, and, in one embodiment, for example, includes twelve of the laser distance measurement sensors 501.

Although the drawings and accompanying description illustrate some exemplary embodiments of a method and process for straightening of thin tubular shapes, a system for straightening of thin tubular shapes, and an apparatus for straightening of thin tubular shapes, it will be apparent that the novel aspects of the present invention may also be carried out by utilizing alternative structures, sizes, shapes, and/or materials in embodiments of the present invention. Also, in other embodiments, components described above with respect to one embodiment may be included together with or interchanged with those of other embodiments.

The preceding description has been presented with reference to certain embodiments of the invention. Persons skilled in the art and technology to which this invention pertains will appreciate that alterations and changes in the described structures and methods of operation can be practiced without meaningfully departing from the principles, spirit, and scope of this invention.

What is claimed is:

1. A method of straightening a thin tubular shape, the method comprising:

supporting a tubular product between a plurality of first support members and a plurality of second support members of a bending apparatus;

applying loads to the tubular product at respective locations along a length of the tubular product using a plurality of actuators of the bending apparatus;

measuring forces and displacements at the respective locations using at least one measuring device;

using a program to calculate whether the measured forces and displacements result in a straightened shape after spring back; and controlling the plurality of actuators to apply the loads based on the calculation of whether the measured forces and displacements result in a straightened shape after spring back.

2. The method of claim 1, further comprising:

calculating a spring back ratio of the tubular product based on the measured forces and displacements; and iteratively increasing the loads applied to the tubular product at the respective locations based on the calculated spring back ratio.

3. The method of claim 1, further comprising:

determining a safe moment at each of the respective locations, wherein the safe moment is indicative of an onset of ovalization of the tubular product; and calculating the loads based on the determined safe moment at each of the respective locations.

4. The method of claim 1, further comprising monitoring a relationship between the measured forces and displacements to detect a yield of the tubular product.

5. The method of claim 4, further comprising dynamically adjusting the loads when the yield of the tubular product is detected.

6. The method of claim 1, wherein the tubular product is a taper tube having a cross-sectional area that decreases along a length of the tubular product.

7. The method of claim 1 further comprising:

determining yield moments along the tubular product to achieve a stress load throughout a length the tubular product;

calculating forces to be applied at the respective locations corresponding to the determined yield moments;

calculating displacements that result from the calculated forces; and determining stroke ratio based on the calculated displacements.

8. A system for straightening thin tubular shapes, the system comprising:

a bending machine including a plurality of first support members configured to support a tubular product at a first side, a plurality of second support members configured to support the tubular product at a second side opposite the first side, and a plurality of actuators, each configured to apply a respective load to a respective first support member of the plurality of first support members;

a plurality of displacement measuring devices associated with respective actuators of the plurality of actuators;

a plurality of force measuring devices associated with the respective actuators of the plurality of actuators; and a computing system connected to each of the plurality of actuators, each of the plurality of displacement measuring devices, and each of the plurality of force measuring devices, wherein the computing system is provided with a program to control forces applied by the plurality of actuators at respective locations of the tubular product along a lengthwise direction to straighten the tubular product.

9. The system of claim 8, further comprising at least one laser distance measurement sensor configured to measure a straightness of the tubular product, wherein the at least one laser distance measurement sensor is connected to the computing system.

10. The system of claim 8, further comprising an unloading sub-system configured to unload the tubular product from the bending machine.

11. The system of claim 8, wherein at least one support member from among at least one of the plurality of first support members or the plurality of second support members is movable along a lengthwise direction of the bending machine.

12. The system of claim 11, wherein locations of the plurality of first support members are fixed along the lengthwise direction of the bending machine.

13. The system of claim 11, wherein the plurality of first support members are movable along the lengthwise direction of the bending machine.

14. The system of claim 11, wherein the plurality of second support members are movable along the lengthwise direction of the bending machine.

15. The system of claim 8, wherein the computing system is further provided with a program to determine yield moments along the tubular product to achieve a stress load throughout a length the tubular product, determine a safe moment at each location of the plurality of actuators, wherein the safe moment is indicative of an onset of ovalization of the tubular product, and compute forces applied by the plurality of actuators at respective locations of the tubular product based on the yield moments and the safe moment at each location of the plurality of actuators.

16. The system of claim 8, wherein the computing system is further provided with a program to calculate a spring back ratio of the tubular product using measurements from the plurality of force measuring devices and measurements from the plurality of displacement measuring devices.

17. The system of claim 8, wherein the computing system is further provided with a program to monitor a relationship between measurements from the plurality of force measuring devices and measurements from the plurality of displacement measuring devices and to detect a yield of the tubular product.

18. A system for straightening thin tubular shapes, the system comprising:

a bending machine including a plurality of first support members configured to support a tubular product at a first side, a plurality of second support members configured to support the tubular product at a second side opposite the first side, and a plurality of actuators, each configured to apply a respective load to a respective first support member of the plurality of first support members;

a plurality of displacement measuring devices associated with respective actuators of the plurality of actuators;

a plurality of force measuring devices associated with the respective actuators of the plurality of actuators; and a computing system connected to each of the plurality of actuators, each of the plurality of displacement measuring devices, and each of the plurality of force measuring devices, wherein the computing system is provided with a program to calculate whether the loads applied by the plurality of actuators result in a straightened shape after spring back, and to control the plurality of actuators to apply the loads based on the calculation of whether the loads applied to the tubular product result in a straightened shape after spring back.

19. The system of claim 18 wherein the computing system is further provided with a program to calculate a spring back ratio of the tubular product based on the measured forces and displacements, and to iteratively increase the loads applied to the tubular product at the respective locations based on the calculated spring back ratio.

20. The system of claim 18 wherein the computing system is further provided with a program to monitor a relationship between the measured forces and displacements to detect a yield of the tubular product.

* * * * *